US005119666A

United States Patent [19]

Fujiwara

[11] Patent Number: 5,119,666

[45] Date of Patent: Jun. 9, 1992

[54] TURRET PUNCH PRESS

[75] Inventor: Takayuki Fujiwara, Isehara, Japan

[73] Assignee: Amada Company, Limited, Japan

[21] Appl. No.: 536,664

[22] PCT Filed: Nov. 17, 1989

[86] PCT No.: PCT/JP89/01175

§ 371 Date: Jul. 10, 1990

§ 102(e) Date: Jul. 10, 1990

[87] PCT Pub. No.: WO90/05601

PCT Pub. Date: May 31, 1990

[30] Foreign Application Priority Data

| | | | |
|---|---|---|---|
| Nov. 18, 1988 | [JP] | Japan | 63-290278 |
| Mar. 28, 1989 | [JP] | Japan | 1-74030 |
| Apr. 13, 1989 | [JP] | Japan | 1-91925 |

[51] Int. Cl.[5] ..... B26F 1/04; B21J 13/03

[52] U.S. Cl. ..... 72/442; 72/446; 72/472; 83/552

[58] Field of Search ..... 72/442, 441, 446, 413, 72/472; 83/552

[56] References Cited

U.S. PATENT DOCUMENTS

| | | | |
|---|---|---|---|
| 3,685,380 | 8/1972 | Daniels | 83/552 |
| 4,250,785 | 2/1981 | Morishita et al. | 83/552 |
| 4,343,210 | 8/1982 | Kuroyone | 83/552 |

FOREIGN PATENT DOCUMENTS

| | | |
|---|---|---|
| 0235100 | 9/1987 | European Pat. Off. . |
| 1502721 | 1/1970 | Fed. Rep. of Germany . |
| 8717398 | 6/1988 | Fed. Rep. of Germany . |
| 2125613 | 9/1972 | France . |
| 8706164 | 4/1987 | PCT Int'l Appl. . |
| 1507590 | 9/1989 | U.S.S.R. . |
| 2030498 | 4/1980 | United Kingdom . |
| 2129729 | 5/1984 | United Kingdom . |

OTHER PUBLICATIONS

IBM Technical Disclosure Bulletin, Dec. 1974, vol. 17, "Electronic Component Assembly Apparatus", pp. 1876-1877.

*Primary Examiner*—David Jones
*Attorney, Agent, or Firm*—Wigman & Cohen

[57] ABSTRACT

A turret punch press includes an upper and lower turrets for respectively supporting a plurality of punches and dies; the punches are arranged two-dimensionally in a punch mounting regions on the upper turret and the dies are arranged two-dimensionally in a die mounting region on the lower turret. The turret punch press further includes a ram and a striker for striking the punches. The striker is provided on a bottom of the ram so as to be movable in two horizontal directions above the punches indexed in a processing region. In the turret punch press, when the turret is indexed in the processing region, many punches and dies are simultaneously indexed in the processing region. Thus, by moving the striker in two horizontal directions above the punches indexed in the processing region, many successive punch operations can be quickly performed without intermediate rotation of the turrets.

8 Claims, 6 Drawing Sheets

TURRET PUNCH PRESS

BACKGROUND OF THE INVENTION

1. Field of the Invention

The present invention relates to a turret punch press comprising rotatable upper and lower turrets which support a plurality of exchangeable punches and dies, and, in particular, to a turret punch press which is provided with a striker movable in two directions in a horizontal plane, for striking the indexed punches and dies, and wherein, once the indexed position of the upper and lower turrets for the processing region has been set, indexings of many punches and dies are done at the same time.

2. Description of the Prior Art

As is commonly known, a turret punch press is provided with a pair of fan- or disc-shaped rotatable upper and lower turrets which face each other in the vertical direction. On the upper and lower turrets, a plurality of punches and dies are provided for performing punching process. In addition, the turret punch press is provided with a ram which is movable in the vertical direction, and on which is mounted a striker for striking the punch which has been indexed (i.e. positioned) in the processing region by the rotation of the turrets. Further, the turret punch press is provided with a workpiece positioning device for positioning a workpiece in the processing region on a worktable, whereby a plate-shaped workpiece is moved in the X- and Y-axis directions.

Generally, in the turret punch press, after necessary punches and dies are indexed in the processing region by the rotation of the upper and lower turrets, the workpiece is positioned by the workpiece positioning device. Next, the punching process is performed on the workpiece by the ram striking the punch.

However, in the conventional turret punch press, because a simple punch and a single die can be indexed at the same time in the processing region by the rotation of the upper and lower turrets, after the punching process is carried out by the punch and die, the necessary indexing of the punch and the die must once again take place before the next punching process is performed by another punches and dies. In the turret punch press, the upper and lower turrets are comparatively heavy so that it is very difficult to quickly accomplish the indexing of the punch and die. Accordingly, the indexing of the punch and die with respect to the processing region must be performed at frequent intervals and considerable time is required. This is very inefficient.

A turret punch press disclosed in U.S. Pat. No. 3,685,380 is an example of a turret punch press in which processing can be performed relatively quickly by a plurality of punches and dies, once the indexing of the upper and lower turrets with respect to the processing region has been done.

In the turret punch press, however, a plurality of punches and dies are arranged in the radial direction of the upper and lower turrets. A striker mounted on the ram is constructed to be movable reciprocally in the radial direction of the turrets to cope with the radial arrangement of the punches and dies. Namely, in the prior arts, the punches and dies are arranged linearly, and the direction of the movement of the striker is also unidimensional. Accordingly, even when the punching process can be carried out by the plurality of punch and die pairs which are indexed with respect to the processing region by one rotation of the upper and lower turrets, no more than about three types of punch and die pairs can be used. Further, the punches and dies are restricted to small diameter tools.

In another conventional turret punch press, punches and dies are arranged uniformly on the circumference of a circle on the turret thereof, and the striker is mounted on the ram so as to be movable above the punches and the dies which are indexed with respect to the processing region.

In this type of configuration, it appears on first glance that the punches and dies are arranged two dimensionally, but if examined in the direction of the movement of the striker, it is seen that the striker can only move unidimensionally on the circumference of a circle, and the punches and dies are arranged unidimensionally on the circumference of the circle. Therefore, the arrangement of the punches and dies cannot be considered as a two-dimentional arrangement and is obviously a unidimensional arrangement.

At any rate, in a conventional turret punch press, no more than about three punch and die pairs can be used with a single rotational indexing of the upper and lower turrets relative to the processing region. Further the punches and dies are restricted to small diameter tools. Accordingly, improving in the processing efficiency is a problem.

SUMMARY OF THE INVENTION

An object of the present invention is to provide, with due consideration to the drawbacks of such conventional devices, a turret punch press in which the punching process can be accomplished by means of a plurality of punches and dies (for example, nine pairs) with a single indexing of the upper and lower turrets with respect to the processing region, and in which the processing efficiency is improved.

This object is achieved in the present invention by the provision of a configuration in which a plurality of punches and dies are arranged two-dimensionally on the upper and lower turrets, so that many punches and dies are simultaneously positioned in the processing region when the indexing of the upper and lower turrets of the turret punch press is carried out relative to the processing region, and in which a striker provided on a ram can move two-dimensionally to cope with the two-dimensional arrangement of the punches and dies.

In the present invention, after the upper and lower turrets are indexed relative to the processing region, the striker is moved toward the striking position above the punch to be struck, and perform the punching process with the specified punche and die. Specifically, because the striker is light-weight, a fast positioning movement is possible and the punching process can be quickly performed by the punches and dies located in the processing region, and the processing efficiency is improved.

In addition, in the punch press, various punches and dies with large and small diameters can be simultaneously positioned in the processing region. Accordingly, in the case that a set of punch processes are to be performed by a plurality of punches and dies, once the upper and lower turrets are indexed with respect to the processing region, the set of processes can be done continuously by the plurality of punches and dies which are positioned in the processing region by the indexing of the turrets; this gives a highly effective improvement in efficiency.

BRIEF DESCRIPTION OF THE DRAWINGS

These and other objects, features, and advantages of the present invention will become more apparent from the following description of the preferred embodiments taken in conjunction with the accompanying drawings, in which.

DETAILED DESCRIPTION OF THE PREFERRED EMBODIMENTS

Figure 1:
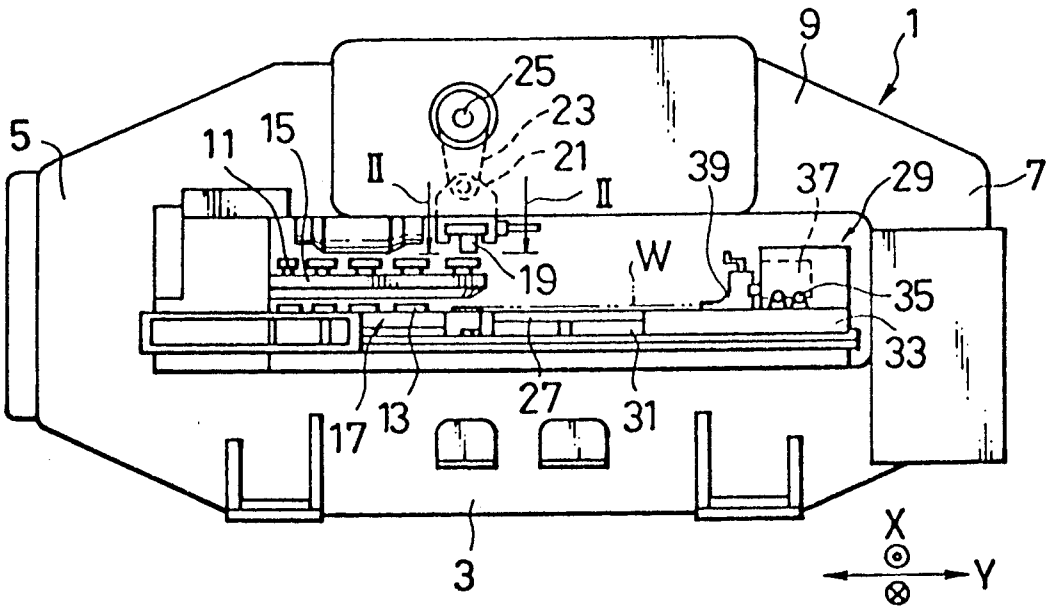
FIG. 1 is a front elevation showing a general configuration of the embodiment of the turret punch press of the present invention.

Now referring to FIG. 1, in this embodiment a turret punch press generally shown by the reference numeral 1, comprises a pair of side frames 5, 7 erected on the two respective ends of a base 3, and an upper frame 9 supported on the side frames 5, 7 to provide a square-arch-shaped frame structure.

On the turret punch press 1, an upper turret 15 and a lower turret 17 are rotatably mounted for supporting a plurality of detachable punches 11 and dies 13.

In addition, the turret punch press 1 is provided with a ram 21 which is movable in the vertical direction. Specifically, the ram 21 can be moved vertically by the rotation of an eccentric section of an eccentric shaft 25 through a connecting rod 23. On the ram 21, a striker 19 is mounted for striking the punch 11.

The turret punch press 1 is also provided with a workpiece positioning device 29 for positioning a workpiece W in the processing position under the striker 19 by moving the workpiece W in the X- and Y-axis directions on the work table 27. The structure of the workpiece positioning device 29 is commonly known, therefore only a brief explanation will be presented here. The workpiece positioning device 29 comprises a carriage base 33 which is guided in the Y-axis direction by a Y-axis guide rail 31, a carriage 37 movable in the X-axis direction guided by an X-axis guide rail 35 provided on the carriage base 33, and a plurality of workpiece clamps 39 mounted on the carriage 37 for clamping the ends of the workpiece W.

In this arrangement, the upper and lower turrets 15, 17 of the turret punch press 1 are rotated, and the desired punch 11 and die 13 are indexed in the processing position under the striker 19. Then, the section of the workpiece W to be processed is positioned in a processing position by the workpiece positioning device 29. Next, the ram 21 descends and the striker 19 strikes the punch 11 so that the workpiece W is punched.

In this embodiment of the present invention, the striker 19 is arranged so as to be movable in horizontal directions under the ram 21, and the punch 11 and die 13 are arranged in a manner such that once the turrets 15, 17 have been indexed in a specified position, many punches 11 and dies 13 are simultaneously positioned in the processing region which is defined by the movable region of the striker 19 in a horizontal plane.

Now referring to FIG. 2, the upper turret 15 is divided into a plurality of punch mounting regions 41A, 41B, . . . 41N, and in each punch mounting region a plurality of punches 11 is detachably provided (because each die 13 corresponds to a punch 11, the explanation of the arrangement of the tools and the like will be made for the punch 11 only in the following).

An origin position 0 is set almost at the center of each punch mounting region 41A, 41B, . . . 41N, and the punches 11 (nine in this embodiment) are mounted so that each punch is at a position with coordinates in the X- and Y-axis directions $(X_1, Y_0)$, $(X_1, Y_1)$ . . . . Namely, the punches 11 are arranged in the horizontal plane two-dimensionally at positions with the coordinates in rectangular coordinate system (X, Y).

In this arrangement, when the upper and lower turrets 15, 17 are rotated so that the indexing of the desired punch mounting region 41A, 41B, . . . is performed with respect to the processing region, the punches 11 and dies 13 provided in each mounting region are simultaneously positioned in the processing region; thus the number of rotations of the turrets 15, 17 to index the punch 11 and die 13 with respect to the processing region can be reduced.

In this embodiment of the present invention, the diameter of the punch 11 is indicated as being uniform, but when the punch 11 at suitable position, for example, at coordinates $(X_1, Y_1)$, has a large diameter, by providing a neighboring punch 11 with a small diameter, or omitting that punch, large and small punches 11 can be mounted on each punch mounting region without any problems.

Each punch 11 mounted in the punch mounting region is supported by a lifter spring 45 mounted in the punch mounting region. The structure of the lifter spring 45 is the same as that of the usual type of lifter spring used to support a punch in a punch press at a position of a specific height. As can be understood from FIG. 2, the punches 11 are positioned close to one another, and one punch 11 shares one lifter spring 45 with the adjacent punch 11. In other words, one lifter spring 45 is constructed to support several adjacent punches 11. By using this type of construction, many punches 11 can be mounted within a punch mounting region 41A, 41B, . . . of limited area.

In order to selectively strike one of the many punches 11 which are positioned in the processing region of the turret punch press 1, the striker 19 is constructed to be movable in two horizontal directions under the ram 21.

Figure 3:
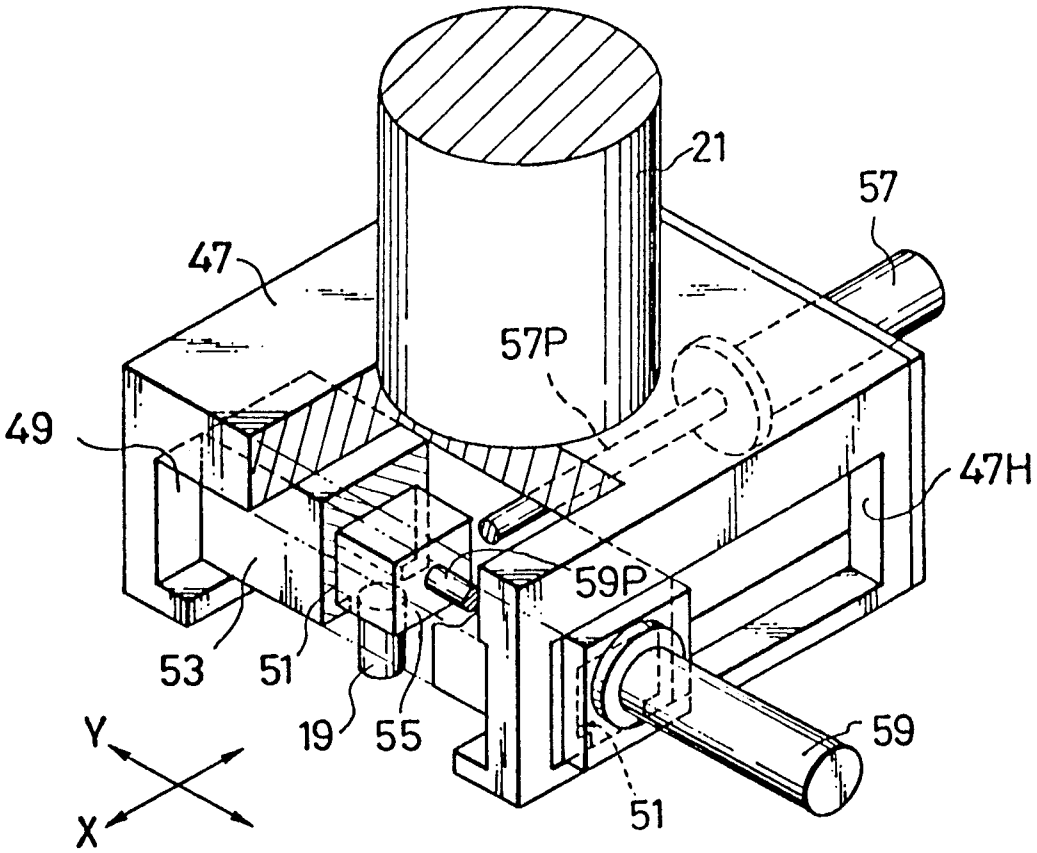
FIG. 3 is a perspective drawing showing an embodiment of a ram and a striker of the punch press, with one part cut away.

More specifically, as shown in FIG. 3, a guide block 47 is installed below the ram 21, and a guide groove 49 is formed in the X-axis direction on the lower surface of the guide block 47. Also a first slider block 53 provided with a guide groove 51 in the Y-axis direction at right angles to the X-axis is supported in a manner allowing free movement in the X-axis direction. A second slider block 55 is supported in a manner allowing free movement in the Y-axis direction in the guide groove 51 of the first slider block 53. The striker 19 is mounted on the bottom surface of the second slider block 55.

A first operating device 57 is mounted on the guide block 47 to move the first slider block 53 in the X-axis direction. In addition, a second operating device 59 is mounted on the first slider block 53 to move the second slider block 55 in the Y-axis direction. The second operating device 59 penetrates an elongated slot 47H which runs in the X-axis direction and is formed in the side surface of the guide block 47. Various configurations, such as a ball screw mechanism with a motor drive and the like, can be adopted for the first and second operation devices 57, 59. However, in this embodiment of the present invention, a plurality of hydraulic cylinders is adopted of a mode in which the cylinders are linked in series, so that the positioning in plurality of positions of the slides blocks 53 or 55 (for example, three position) can easily be carried out.

Specifically, a piston rod 57P provided in a freely reciprocating manner on the first operating device 57 is connected to the first slider block 53. Also, a piston rod 59P provided in a freely reciprocating manner on the second operating device 59 is connected to the second slider block 55.

Accordingly, the first slider block 53 can be moved in the X-axis direction along the guide groove 49 by the action of the first operating device 57, and can thereby be positioned in a plurality of positions in X-axis direction. Thus, the second slider block 55, which is supported on the first slider block 53, and the striker 19 can be positioned in the plurality of positions in the X-axis direction. Also, the second slider block 55 can be moved in the Y-axis direction along the guide groove 51 of the first slider block 53 by the action of the second operating device 59, and can thereby be positioned in a plurality of position in the Y-axis direction.

As has already been explained, by means of this embodiment, the striker 19 can be moved two-dimensionally by the action of the first and second operating devices 57 and 59, and can be located in any positions in the X- and Y-axis directions. Thus, the striker 19 can move to and be selectively located in a position corresponding to one of the punches 11 which are indexed in the processing region of the turret punch press 1.

Specifically, by means of this embodiment of the present invention, once the upper and lower turrets 15, 17 have been indexed, the punches 11 and the dies 13 provided in the punch mounting region are simultaneously positioned in the processing region. Then by positioning and striking the striker 19 at the positions corresponding to each punch 11 in sequence, the punching process can be carried out in sequency by the punches 11 and dies 13 positioned in the processing region. In this case, it is sufficient to move two dimensionally the striker 19 and simply position it. The rotary indexing of the upper and lower turrets 15, 17 is unnecessary. Therefore, the punching process can be quickly performed by the punches 11 and the dies 13, so that the processing efficiency is improved.

Figure 4:
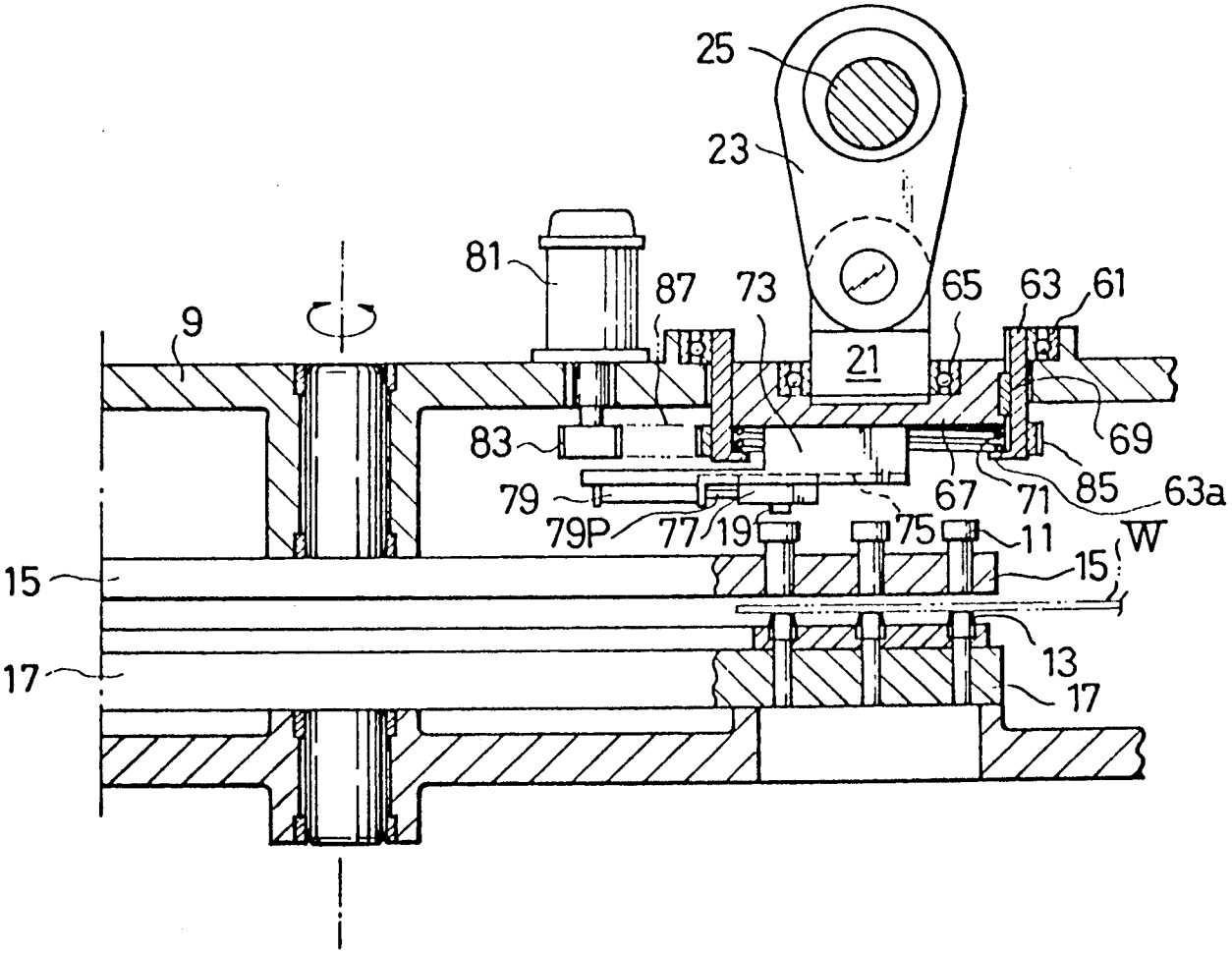
FIG. 4 is a front elevation showing another embodiment of a ram and a striker.

FIG. 4 shows a second embodiment of the present invention. In this embodiment, a rotatable tube 63 is rotatably supported through a bearing 61 on the frame 9. Inside the rotatable tube 63, a swivel member 67 is provided in a manner such that it is engaged with the tube 63 through a key 69 to allow a freely vertical movement. The swivel member 61 is coupled to the bottom section of the ram 21 at its center section through a bearing 65 to allow a freely swivelling action.

A spring 71 is provided between the lower surface of the swivel member 67 and an inside flange section 63*a* of the rotatable tube 63, energizing the swivel member 67 in the upward direction.

A guide arm 73 extending in the radial direction of the swivel member 67 is integrally installed on the lower surface of the member 67. A moving block 77, on which the striker 19 is provided, is supported in a freely movable manner in a guide groove 75 formed in the radial direction in the lower surface of the guide arm 73. A freely reciprocating piston rod 79P in a hydraulic cylinder 79 mounted on the guide arm 73 is connected to the moving block 77.

A motor 81 is mounted on the frame 9 to rotate and position the rotatable tube 63. Specifically, a belt 87, such as a timing belt, runs between a drive pulley 83 provided on the output shaft of the motor 81 and a driven pulley 85 provided on the outer peripheral surface of the rotatable tube 63.

From this configuration, the moving block 77 and the striker 19 can move in the radial direction and be positioned by the action of the hydraulic cylinder 79. Also, by suitably driving the motor 81, the striker 19 can be rotated and positioned via the rotatable tube 63 and the swivel member 67.

Figure 2:
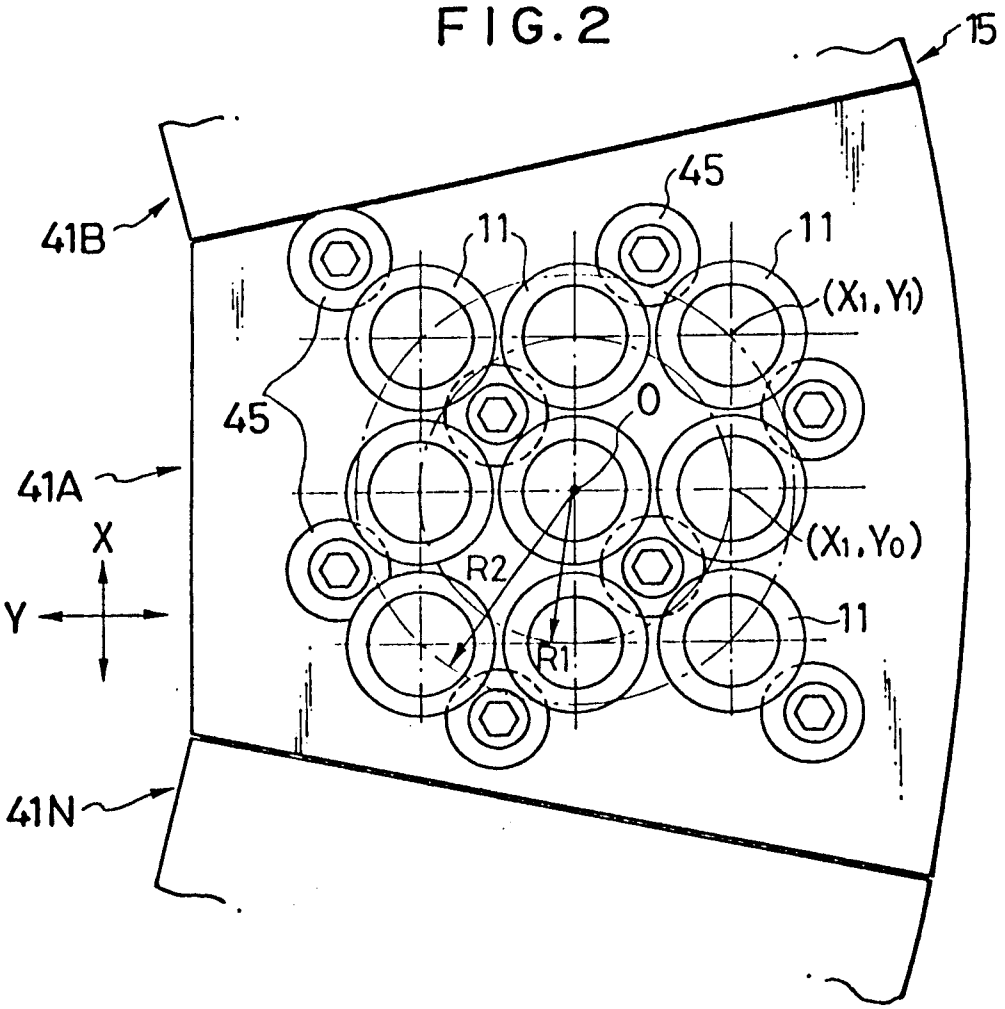
FIG. 2 is a drawing showing an example of the arrangement of a punch on an upper turret of the punch press, and corresponds to an enlarged drawing viewed in the direction of the arrows II—II in FIG. 1.

Specifically, in the configuration where the center of rotation of the rotatable tube 63 is located above the origin position 0 shown in FIG. 2, the striker 19 can be positioned on the radius R1 or the radius R2 position by the action of the hydraulic cylinder 79, and the striker 19 can be set in suitable angular positions corresponding to each punch 11 by the rotation of the rotatable tube 63 using the motor 81.

Accordingly, in the case of the second configuration of the present invention, the punch 11 can be seen as having a configuration positioned two-dimensionally relative to the polar coordinates; in addition, the positioning of the striker 19 can also be performed in two dimensions relative to the polar coordinates.

Figure 5:
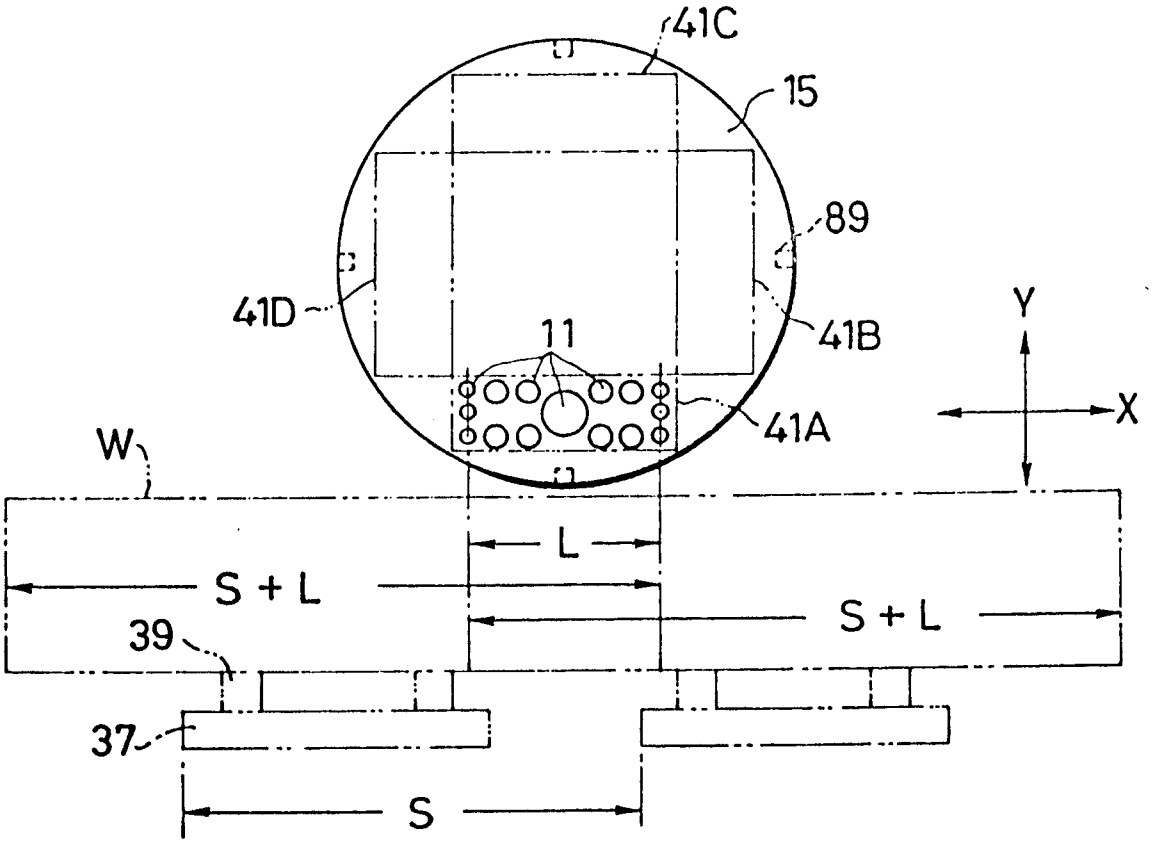
FIG. 5 is a plan view showing an arrangement of the punches on the turret in the case where the punch mounting region of the turret is divided into four parts.

Referring now to FIG. 5, in the case where the punch mounting region of the upper turret 15 is divided into four parts 41A, 41B, 41C, 41D, and the area of each of the punch mounting regions 41A to 41D is large, it is possible to have a larger number of mountings for the punches 11 and dies 13, and the rotary indexing of the upper turret 15 is performed every 90°. Thus, it is possible to speed up and simplify the indexing.

Specifically, the angle of rotation of the upper turret 15 is either one of 90° amd 180°, thereby the turret being rotated at high speed. Also, only four engaging holes 89 for engaging a short pin (omitted from the drawings) are needed to set the indexing position of the upper turret 15, so that the process to manufacture the turret is simplified and easily performed.

Furthermore, in the configuration outlined above, as shown in FIG. 5, the dimension L in the X-axis direction of each of the punch mounting regions 41A to 41D is comparatively long, so that, even when the stroke length of the carriage 37 in the X-axis direction is S, it can accommodate the workpiece W with the length (S+L) in the X-axis direction.

Figure 6:
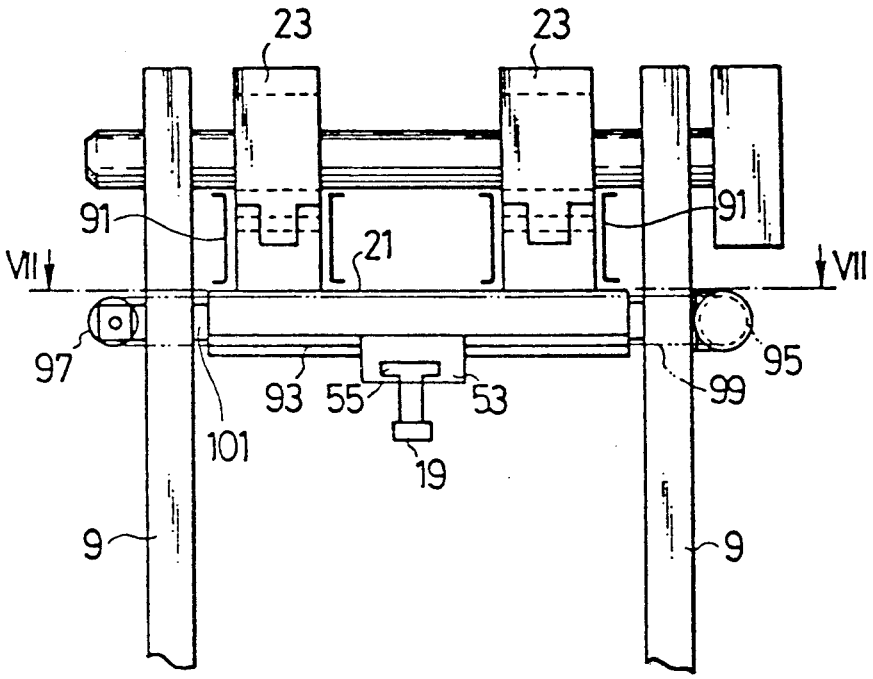
FIG. 6 is an explanatory drawing showing a desirable support structure for the ram which is mounted on a punch press having the arrangement of the punches shown in FIG. 5.
Figure 7:
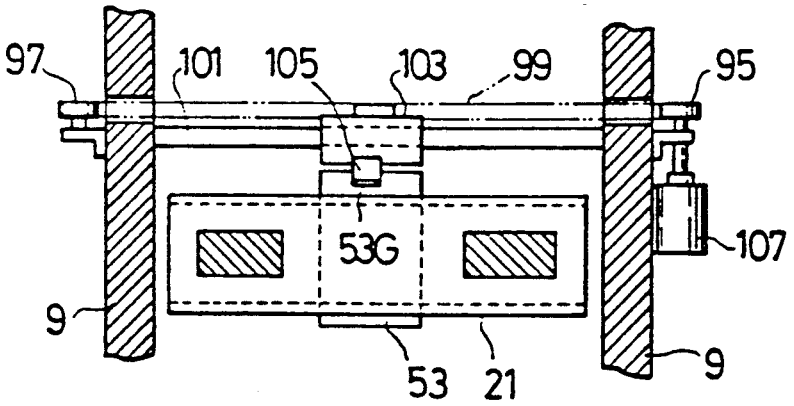
FIG. 7 is a sectional drawing showing the section viewed along the line VII—VII in FIG. 6.

When the punch mounting regions 41A, 41B, 41C and 41D are comparatively long in the X-axis direction as in the above configuration, it is preferable to have a striking device with a configuration such as that shown in FIG. 6 and FIG. 7.

Specifically, referring to FIG. 6 and FIG. 7, the ram 21 is comparatively long in the X-axis direction, the connecting rod 23 is connected close to both ends of the ram 21, and the ram 21 is guided by a guide 91 so as to be movable in vertical direction. A first slider block 53 is guided in the X-axis direction by a guide section 93 provided on the lower surface of the ram 21. A second slider block 55, which is equipped with the striker 19, is mounted on the first slider block 53 so that it can move freely in the Y-axis direction. The relationship between the first slider block 53 and the second slider block 55 is the same as in the configuration already explained in FIG. 3.

In this embodiment, a pair of pulleys 95, 97 are rotatably provided on both sides of the frame 9 for moving the first slider block 53 in the X-axis direction. As shown particularly in FIG. 7, the pulleys 95, 97 are connected to a moving block 103 which is movable along a guide rail 101 provided between the pulleys 95, 97. Then, a perpendicular key 105 provided on the moving block 103 is engaged with a key groove 53G formed in the first slider block 53, so that the first slider block 53 is connected to the moving block 103 in a manner such that it is movable in the vertical direction. Furthermore, a motor 107 such as a pulse motor or the like is mounted on the frame 9 for rotating a pulley 95.

Accordingly, in the configuration explained above, the first slider block 53, driven by the motor 107, can be moved a long distance in the X-axis direction and positioned. Thus, the device can cope with the case where the punch mounting region is comparatively long.

Also, when the punch 11 located close to either one of sides of the punch mounting region is struck, an unbalanced load will act on the ram 21; however, in the above-mentioned embodiment, because the ram 21 is connected to the connecting rod 23 at both sides thereof, the device can cope with such unbalanced load.

As can be understood from the explanation of an embodiment such as the above, by means of the present invention, when the turret is positionally indexed in the processing region of the turret punch press, many punches and dies arranged in one plane (two-dimensionally) can be positioned in the processing region. Then, the striker which strikes the punch is moved two-dimensionally, and many punches can be performed in sequence. Therefore, the efficiency of the punching process can be improved in comparison with the efficiency of a conventional turret punch press.

What is claimed is:

1. A turret punch press comprising:

a frame;

an upper turret means mounted on the frame for supporting a plurality of punches the upper turret means being divided into a plurality of punch mounting regions each of which can be indexed in a processing region of the punch press, the punches each being arranged two-dimensionally in punch mounting regions on the upper turret;

a lower turret means for supporting a plurality of dies corresponding to the punches, the dies being arranged two-dimensionally in die mounting regions on the lower turret;

a ram mounted on the frame so as to be movable in the vertical direction; and a striker provided on the ram for striking the punches, the striker being provided on a bottom section of the ram so as to be movable in two mutually-perpendicular and horizontal directions.

2. The turret punch press of claim 1 further comprising a second slide block for supporting the striker and a first slide block for supporting the second slide block so as to be movable in a Y-axis direction, the first slide block being supported on the bottom section of the ram, movable in a X-axis direction perpendicular to the Y-axis direction.

3. The turret punch press of claim 2 wherein an operating device for moving the first slide block and an operating device for moving the second striker block comprises a plurality of hydraulic cylinders for moving and positioning each block in a plurality of positions.

4. A turret punch press comprising:

a frame;

an upper turret means mounted on the frame for supporting a plurality of punches, the punches being arranged two-dimensionally in a punch mounting region on the upper turret;

a lower turret means for supporting a plurality of dies corresponding to the punches, the dies being arranged two-dimensionally in a die mounting region on the lower turret;

a ram mounted on the frame so as to be movable in the vertical direction;

a striker provided on the ram for striking the punches, the striker being provided on a bottom section of the ram so as to be movable in horizontal directions above the punches which are mounted in the punch mounting region of the turret and are indexed in a processing region; and a swivel member supported on the frame in a manner allowing free rotation around the ram;

wherein the striker is supported on the swivel member in a manner allowing free movement in a radial direction of the swivel member on the bottom of the ram.

5. The turret punch press of claim 1, wherein the plurality of punches and dies arranged on the upper and lower turrets are arranged two-dimensionally with respect to orthogonal coordinates or polar coordinates.

6. A turret punch press comprising:

a frame;

an upper turret means mounted on the frame for supporting a plurality of punches, the punches being arranged two-dimensionally in a punch mounting region on the upper turret;

a lower turret means for supporting a plurality of dies corresponding to the punches, the dies being arranged two-dimensionally in a die mounting region on the lower turret;

a ram mounted on the frame so as to be movable in the vertical direction;

a striker provided on the ram for striking the punches, the striker being provided on a bottom section of the ram so as to be movable in horizontal directions above the punches which are mounted in the punch mounting region of the turret and are indexed in a processing region;

wherein the plurality of punches and dies arranged on the upper and lower turrets are arranged two-dimensionally with respect to orthogonal coordinates or polar coordinates; and wherein the punches are arranged adjacent to one another on the upper turret, and a lift spring is located between the adjacent punches and is used in common by the adjacent punches.

7. A turret punch press comprising:

a frame;

an upper turret means mounted on the frame for supporting a plurality of punches, the punches being arranged two-dimensionally in a punch mounting region on the upper turret;

a lower turret means for supporting a plurality of dies corresponding to the punches, the dies being arranged two-dimensionally in a die mounting region on the lower turrets;

a ram mounted on the frame so as to be movable in the vertical direction;

a rotatable member supported in a freely rotatable manner on the frame;

a swivel member engaged with the rotatable member so as to be movable in the vertical direction, the swivel member being rotatably coupled to a bottom section of the ram;

a movable block supported on a bottom surface of the swivel member so as to be movable in a radial direction of the swivel member; and a striker provided on the movable block for striking the punches.

8. A turret punch press comprising:

a frame;

an upper turret mounted on the frame for supporting a plurality of punches, the upper turret means being divided into a plurality of rectangular punch mounting regions each of which can be indexed in a processing region of the punch press, the punches being arranged two-dimensionally in each rectangular punch mounting region on the upper turret;

a lower turret mounted on the frame for supporting a plurality of dies corresponding to the punches, the dies being arranged two-dimensionally in a rectangular die mounting region on the lower turrets;

a ram supported on the frame so as to be movable in a vertical direction, the ram having a longitudinal shape corresponding to the arrangement of the punches and dies, and being connected to drive means for moving the ram vertically at or near both sides of the ram; and a striker being provided on the ram so as to be movable in two mutually-perpendicular and horizontal directions.

* * * * *